US006267565B1

(12) United States Patent
Seibel et al.

(10) Patent No.: US 6,267,565 B1
(45) Date of Patent: Jul. 31, 2001

(54) SCROLL TEMPERATURE PROTECTION

(75) Inventors: Stephen M. Seibel, Celina; James F. Fogt, Sidney, both of OH (US)

(73) Assignee: Copeland Corporation, Sidney, OH (US)

( * ) Notice: Subject to any disclaimer, the term of this patent is extended or adjusted under 35 U.S.C. 154(b) by 0 days.

(21) Appl. No.: 09/382,844

(22) Filed: Aug. 25, 1999

(51) Int. Cl.[7] ..... F04B 49/00
(52) U.S. Cl. ..... 417/292; 62/196.3
(58) Field of Search ..... 62/197, 196.3; 417/292, 272, 310, 32; 123/235

(56) References Cited

U.S. PATENT DOCUMENTS

| | | | | |
|---|---|---|---|---|
| Re. 35,216 | * | 4/1996 | Anderson et al. | 417/310 |
| 912,866 | | 2/1909 | Massa . | |
| 1,942,433 | | 1/1934 | Lindsay . | |
| 2,062,052 | | 11/1936 | Horlacher . | |
| 2,069,767 | | 2/1937 | McCormack . | |
| 2,373,909 | | 4/1945 | Penn . | |
| 4,335,582 | | 6/1982 | Shaw et al. . | |
| 4,431,388 | | 2/1984 | Eber et al. . | |
| 4,496,296 | | 1/1985 | Arai et al. . | |
| 4,497,615 | | 2/1985 | Griffith . | |
| 4,596,520 | | 6/1986 | Arata et al. . | |
| 4,747,756 | | 5/1988 | Sato et al. . | |
| 4,820,130 | | 4/1989 | Eber et al. . | |
| 4,840,545 | | 6/1989 | Moilanen . | |
| 4,877,382 | | 10/1989 | Caillat et al. . | |
| 4,912,932 | | 4/1990 | Malaker et al. . | |
| 4,940,395 | | 7/1990 | Yamamoto et al. . | |
| 4,968,232 | | 11/1990 | Kikuchi . | |
| 5,074,761 | | 12/1991 | Hirooka et al. . | |
| 5,076,067 | * | 12/1991 | Prenger et al. | 62/197 |
| 5,102,316 | | 4/1992 | Caillat et al. . | |
| 5,141,407 | * | 8/1992 | Ramsey et al. | 417/292 |
| 5,156,539 | | 10/1992 | Anderson et al. . | |
| 5,167,491 | | 12/1992 | Keller, Jr. et al. . | |
| 5,169,294 | | 12/1992 | Barito . | |
| 5,186,613 | | 2/1993 | Kotlarek et al. . | |
| 5,240,389 | | 8/1993 | Oikawa et al. . | |
| 5,248,244 | * | 9/1993 | Ho et al. | 417/292 |
| 5,290,154 | * | 3/1994 | Kotlarek et al. | 417/272 |
| 5,293,850 | * | 3/1994 | Nishida | 123/235 |
| 5,320,507 | | 6/1994 | Monnier et al. . | |
| 5,336,058 | | 8/1994 | Yokoyama . | |
| 5,378,129 | | 1/1995 | Dunaevsky et al. . | |
| 5,591,014 | | 1/1997 | Wallis et al. . | |
| 5,607,288 | | 3/1997 | Wallis et al. . | |
| 5,707,210 | * | 1/1998 | Ramsey et al. | 417/32 |

* cited by examiner

*Primary Examiner*—Teresa Walberg
*Assistant Examiner*—L. Fastovsky
(74) *Attorney, Agent, or Firm*—Harness, Dickey & Pierce, P.L.C.

(57) ABSTRACT

A scroll compressor includes a first scroll member and a second scroll member with intermediate spiral wraps. A drive member causes the scroll member to orbit relative to one another to create pockets of progressively changing volume between a discharge pressure zone and a suction pressure zone. One of the scroll members defines a chamber which contains fluid, a pressure intermediate the discharge pressure and suction pressure of the compressor. A temperature responsive valve is located within the chamber to release the intermediate pressure fluid to the suction pressure zone of the compressor when an excessive temperature is sensed.

28 Claims, 8 Drawing Sheets

SCROLL TEMPERATURE PROTECTION

FIELD OF THE INVENTION

The present invention relates to scroll type machinery. More particularly, the present invention relates to scroll compressors having a unique temperature protection system which protects the scroll machine from overheating.

BACKGROUND AND SUMMARY OF THE INVENTION

A typical scroll machine has an orbiting scroll member which has a spiral wrap on one face thereof and a non-orbiting scroll member having a spiral wrap on one face thereof. The spiral wraps are intermeshed with one another and a mechanism is provided for causing the orbiting scroll member to orbit about an axis with respect to the non-orbiting scroll. This orbiting action will cause the wraps to create pockets of progressively decreasing volume from a suction zone to a discharge zone.

One problem associated with these scroll machines is their ability to create excessive discharge gas temperatures due to various field encountered problems. One known method of solving the problem is to cause a high-side to low-side leak of the compressed gas when these excessive temperature conditions are encountered. The prior art includes numerous systems that have been developed in response to this identified problem.

One of the primary objectives of the present invention is to provide an improved system for temperature protection. The improved system of the present invention is a simple temperature responsive valve which is simple in construction, easy to install and inspect and which improves the desired control for the compressor.

The valve of the system of the present invention improves the high pressure relief of compressed gas and hence the high temperature protection for these machines. The system of the present invention is particularly effective in scroll machines where suction gas is used to cool the motor driving the orbiting scroll member. The reason for this is because the valve will create a leak from the high side of the compressor to the low side of the compressor at conditions where discharge gas in the high side is at an elevated temperature. The leakage of this high temperature discharge gas to the suction area of the compressor causes the standard motor protector for the motor to trip and shut down the operation of the scroll machine.

The present invention therefore provides protection from excessive discharge temperature which could result from (a) loss of working fluid charge; (b) a low pressure condition or a blocked suction condition; (c) a blocked condenser fan in a refrigeration system; or (d) an excess discharge pressure condition regardless of the reason. All of these undesirable conditions will cause a scroll machine to function at a pressure ratio much greater than that which is designed into the machine in terms of its predetermined fixed volume ratio, and this will in turn cause excessive discharge temperatures.

Other advantages and objects of the present invention will become apparent to those skilled in the art from the subsequent detailed description, appended claims and drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENT

Figure 1:
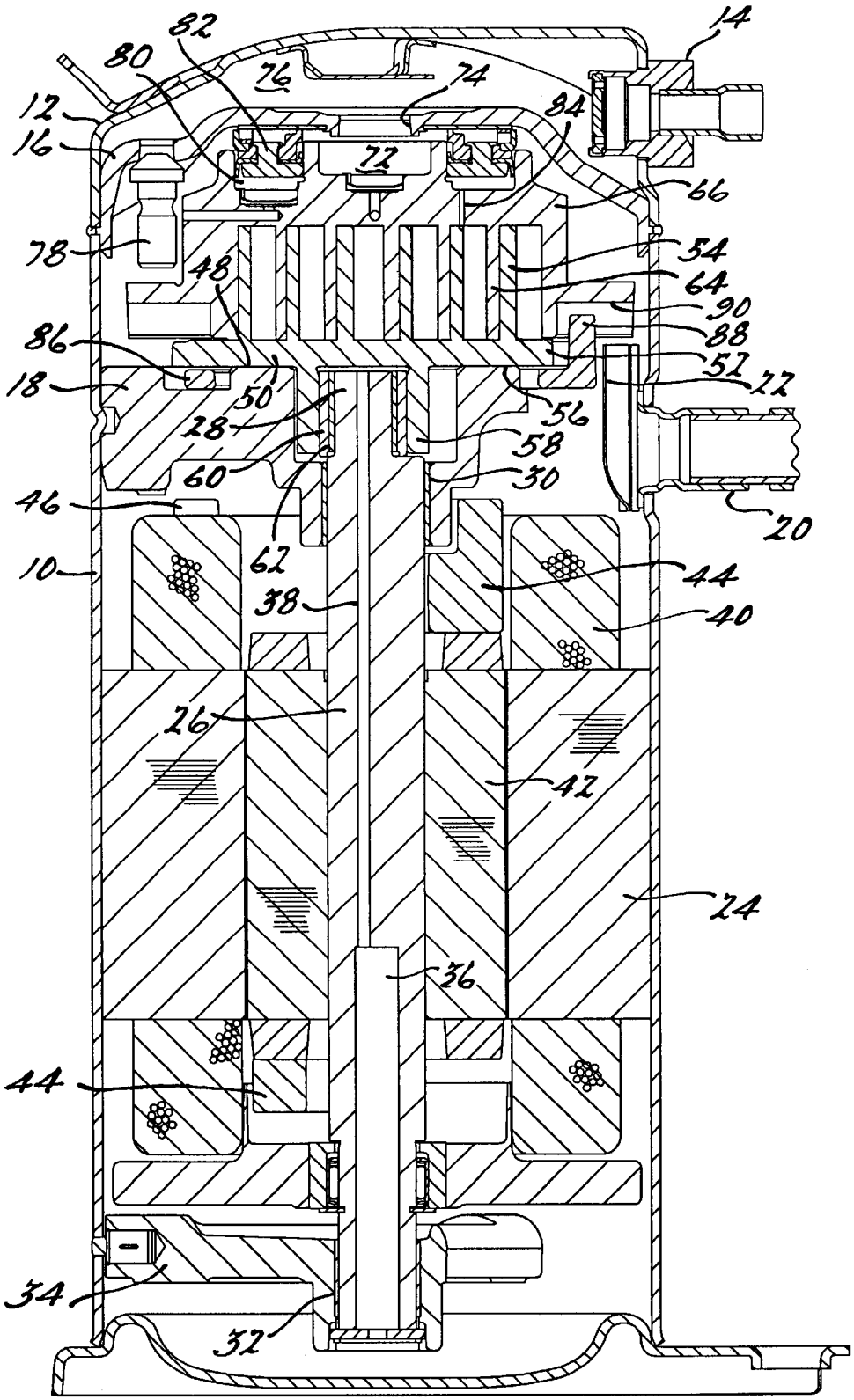
FIG. 1 is a vertical cross-sectional view through a scroll compressor incorporating the unique temperature protection system in accordance with the present invention.

While the present invention is suitable for incorporation in many different types of scroll machines, for exemplary purposes it will be described herein incorporated in a hermetic scroll refrigerant motor-compressor of the "low side" type (i.e., where the motor and compressor are cooled by suction gas in the hermetical shell, as illustrated in the vertical section shown in FIG. 1). Generally speaking, the compressor comprises a cylindrical hermetic shell 10 having welded at the upper end thereof a cap 12, which is provided with a refrigerant discharge fitting 14 optionally having the usual discharge valve therein. Other elements affixed to the shell include a transversely extending partition 16 which is welded about its periphery at the same point that cap 12 is welded to shell 10, a main bearing housing 18 which is affixed to shell 10 at a plurality of points in any desirable manner, and a suction gas inlet fitting 20 having a gas deflector 22 disposed in communication therewith inside the shell.

A motor stator 24 which is generally square in cross-section but with the corners rounded off is press fit into shell 10. The flats between the rounded corners on the stator provide passageways between the stator and shell which facilitate the flow of lubricant from the top of the shell to the bottom. A crankshaft 26 having an eccentric crank pin 28 at the upper end thereof is rotatably journaled in a bearing 30 in main bearing housing 18 and a second bearing 32 in a lower bearing housing 34. Crankshaft 26 has at the lower end the usual relatively large diameter oil-pumping concentric bore 36 which communicates with a radially outwardly inclined smaller diameter bore 38 extending upwardly therefrom to the top of the crankshaft. The lower portion of the interior shell 10 is filled with lubricating oil in the usual manner and concentric bore 36 at the bottom of the crankshaft is the primary pump acting in conjunction with bore 38, which acts as a secondary pump, to pump lubricating fluid to all the various portions of the compressor which require lubrication.

Crankshaft 26 is rotatively driven by an electric motor including stator 24 having windings 40 passing therethrough, and a rotor 42 press fit on the crankshaft and having one or more counterweights 44. A motor protector 46, of the usual type, is provided in close proximity to motor windings 40 so that if the motor exceeds its normal temperature range the protector will de-energize the motor.

The upper surface of main bearing housing 18 is provided with an annular flat thrust bearing surface 48 on which is disposed an orbiting scroll member 50 comprising an end plate 52 having the usual spiral vane or wrap 54 on the upper surface thereof, an annular flat thrust surface 56 on the lower surface, and projecting downwardly therefrom a cylindrical hub 58 having a journal bearing 60 therein and in which is rotatively disposed a drive bushing 62 having an inner bore in which crank pin 28 is drivingly disposed. Crank pin 28 has a flat on one surface (not shown) which drivingly engages a flat surface in a portion of inner bore of drive bushing 62 to provide a radially compliant driving arrangement, such as shown in assignee's U.S. Pat. No. 4,877,382, the disclosure of which is herein incorporated by reference.

Wrap 54 meshes with a non-orbiting spiral wrap 64 forming a part of non-orbiting scroll member 66 which is mounted to main bearing housing 18 in any desired manner which will provide limited axial movement of scroll member 66. The specific manner of such mounting is not relevant to the present inventions, however, in the present embodiment, for exemplary purposes, non-orbiting scroll member 66 has a plurality of circumferentially spaced mounting bosses each having a flat upper surface and an axial bore in which is slidably disposed a sleeve which is bolted to main bearing housing 18 by a bolt as is known in the art. The bolt has an enlarged head having a flat lower surface which engages the upper surface of non-orbiting scroll member 66 to limit the axially upper or separating movement of non-orbiting scroll member 66. Movement in the opposite direction is limited by axial engagement of the lower tip surface of wrap 64 and the flat upper surface of orbiting scroll member 50. For a more detailed description of the non-orbiting scroll suspension system, see assignee's U.S. Pat. No. 5,055,010, the disclosure of which is hereby incorporated herein by reference.

Non-orbiting scroll member 66 has a centrally disposed discharge passageway communicating with an upwardly open recess 72 which is in fluid communication via an opening 74 in partition 16 with a discharge muffler chamber 76 defined by cap 12 and partition 16. An intermediate pressure relief valve 78 is disposed between the discharge muffler chamber 76 and the interior of shell 10. The intermediate relief valve 78 will open at a specified differential pressure between the discharge and suction pressures to vent pressurized gas from the discharge muffler chamber 76. Non-orbiting scroll member 66 has in the upper surface thereof an annular recess 80 having parallel coaxial side walls in which is sealingly disposed for relative axial movement an annular floating seal 82 which serves to isolate the bottom of recess 80 from the presence of gas under suction and discharge pressure so that it can be placed in fluid communication with a source of intermediate fluid pressure by means of a passageway 84. Non-orbiting scroll member 66 is thus axially biased against the orbiting scroll member by the forces created by discharge pressure acting on the central portion of scroll member 66 and those created by intermediate fluid pressure acting on the bottom of recess 80. This axial pressure biasing, as well as various techniques for supporting scroll member 66 for limited axial movement, are disclosed in much greater detail in assignee's aforesaid U.S. Pat. No. 4,877,328.

Relative rotation of the scroll members is prevented by the usual Oldham coupling comprising a ring 86 having a first pair of keys 88 (one of which is shown) slidably disposed in diametrically opposed slots 90 (one of which is shown) in scroll member 66 and a second pair of keys (not shown) slidably disposed in diametrically opposed slots in scroll member 50.

Figure 2:
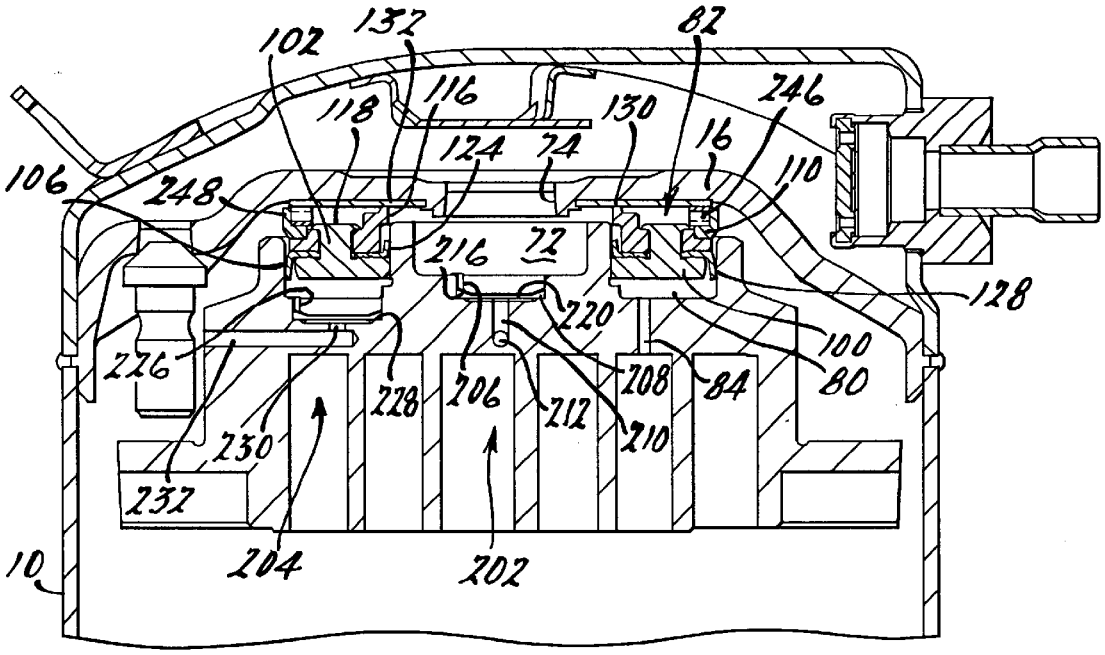
FIG. 2 is an enlarged cross-sectional view of the upper portion of the scroll machine shown in FIG. 1 which includes the temperature control system in accordance with the present invention.

Referring now to FIG. 2. Although the details of construction of floating seal 82 are not part of the present invention, for exemplary purposes seal 82 is of a coaxial sandwiched construction and comprises an annular base plate 100 having a plurality of equally spaced upstanding integral projections 102. Disposed on plate 100 is an annular gasket 106 having a plurality of equally spaced holes which receive projections 102. On top of gasket 106 is disposed an upper seal plate 110 having a plurality of equally spaced holes which receive base portions 104. Seal plate 110 has disposed about the inner periphery thereof an upwardly projecting planar sealing lip 116. The assembly is secured together by swaging the ends of each of the projections 102, as indicated at 118.

The overall seal assembly therefor provides three distinct seals; namely, an inside diameter seal at 124, an outside diameter seal at 128 and a top seal at 130. Seal 124 is between the inner periphery of gasket 106 and the inside wall of recess 80. Seal 124 isolates fluid under intermediate pressure in the bottom of recess 80 from fluid under discharge pressure in recess 72. Seal 128 is between the outer periphery of gasket 106 and the outer wall of recess 80, and isolates fluid under intermediate pressure in the bottom of recess 80 from fluid at suction pressure within shell 10. Seal 130 is between sealing lip 116 and an annular wear ring 132 surrounding opening 74 in partition 16, and isolates fluid at suction pressure from fluid at discharge pressure across the top of the seal assembly. The details of the construction of seal 82 is similar to that described in U.S. Pat. No. 5,156,539, the disclosure of which is hereby incorporated herein by reference.

The compressor is preferably the "low side" type in which suction gas entering via deflector 22 is allowed, in part, to escape into the shell and assist in cooling the motor. So long as there is an adequate flow of returning suction gas the motor will remain within desired temperature limits. When this flow drops significantly, however, the loss of cooling will eventually cause motor protector 46 to trip and shut the machine down.

The scroll compressor as thus far broadly described, with the exception of a temperature protection system 200, is either now known in the art or is the subject of other pending applications for patents assigned to the assignee of the present invention. The details of construction which incorporate the principles of the present invention are those which deal with the unique temperature protection system indicated generally by reference numeral 200. Temperature protection system 200 causes the compressor to cease any significant pumping if the discharge gas reaches excessive temperatures. The ceasing of pumping action deprives the motor of its normal flow of cooling gas. The leak of discharge gas to the suction area of the compressor circulates the high temperature discharge gas around and through the motor increasing the temperature of stator 24 and windings 40. The increase in temperature of stator 24 and windings 40 will heat up the standard motor protector 46 which will then trip and de-energize the motor.

Temperature protection system 200 comprises a temperature responsive valve assembly 202 and a temperature responsive valve assembly 204. Temperature responsive valve assembly 202 comprises a circular valve cavity 206 disposed in the bottom of recess 72 and having an annular step 208. The bottom of cavity 206 communicates with an axial passage 210 of circular cross section which in turn communicates with a radial passage 212. The radially outer outlet end of passage 212 is in communication with the suction gas region within shell 10. The intersection of passage 210 and the planar bottom of cavity 206 defines a circular valve seat in which is normally disposed the spherical center valving portion of a circular slightly spherical relatively thin saucer-like bimetallic valve 214 having a plurality of through holes disposed radially outwardly of the spherical valving portion.

Valve 214 is retained in place by a cup-shaped spider-like retaining ring 220 which has an open center portion and a plurality of spaced radially outwardly extending fingers 222 which are normally of slightly larger diameter than the side wall of cavity 206. After valve 214 is assembled in place, retaining ring 220 is pushed into cavity 206 until it bottoms out on a plurality of flanges which extend from fingers 222. Retaining ring 220 is held in place by fingers 222 engaging the side wall of cavity 206.

Being disposed in discharge gas recess 72, valve assembly 202 is fully exposed to the temperature of the discharge gas very close to the point it exits scroll wraps 54 and 64. The closer the location at which the discharge gas temperature is sensed to the actual discharge gas temperature existing in the last scroll compression pocket the more accurately the machine will be controlled in response to discharge temperature. The materials of bimetallic valve 214 are chosen, using conventional criteria, so that when discharge gas reaches a predetermined value, which is considered excessive, valve 214 will "snap" into its open position in which it is slightly concave upwardly with its outer periphery engaging step 208 and its center valving portion elevated away from the valve seat. In this position, high pressure discharge gas can leak through the holes in valve 214 and passages 210 and 212 to the interior of shell 10 at suction pressure. This leakage causes the discharge gas to be recirculated thus reducing the inflow of cool suction gas as a consequence of which the motor loses its flow of cooling liquid, i.e., the inlet flow of relatively cool suction gas. Motor protector 46, motor windings 40 and stator 24 therefore heat up due to both the presence of relatively hot discharge gas and the reduced flow of suction gas. Motor windings 40 and stator 24 act as a heat sink to eventually trip motor protector 46 thus shutting down the compressor.

One of the problems associated with the prior art systems which incorporated only valve assembly 202 is the time delay from when valve 214 reacts and when motor protector 46 trips. In certain circumstances this time delay can be excessive causing damage to one or both of scroll members 50 and 66. After valve 214 has snapped open and while the discharge gas is heating the motor mass, the gas discharge temperature can increase rapidly. Excessive scroll temperatures created by the high temperature discharge gas can lead to vane tip galling.

Another problem associated with valve assembly 202 is that valve 214 cannot open when there is a large differential between the suction and discharge pressure. The bi-metal disc generates only a few pounds of force that must overcome the pressure differential acting across the passage area before it can open. This limits the size of passage 210 and thus the amount of discharge gas that can be bi-passed to heat the motor. This limitation is particularly restrictive with the new environmental friendly refrigerants since they operate at higher pressures resulting in higher pressure differentials. Thus, placing only valve 214 in the discharge region optimizes the sensing of the discharge gas temperature, but it restricts the gas flow and may hinder the optimum sizing of the inner seal diameter.

Temperature protection for the compressor is required when the actual operating pressure ratio of the compressor is well above the design pressure ratio. It has been found that successful temperature protection of the scrolls is achieved when excessively pressurized discharge gas is bypassed to the suction area of the compressor at a sufficient rate that the resulting pressure ratio is reduced to or below the design pressure ratio of the compressor. This cannot be achieved with only valve assembly 202 due to its inherent passage size limitation. Thus, the present invention includes valve assembly 204.

Temperature responsive valve assembly 204 comprises a circular valve cavity 226 disposed in the bottom of recess 80 and having an annular step 228. The bottom of cavity 226 communicates with an axial passage 230 of circular cross section which in turn communicates with a radial passage 232. The radially outer outlet end of passage 232 is in communication with the suction gas region within shell 10. The intersection of passage 230 and the planar bottom of cavity 226 defines a circular valve seat in which is normally disposed the spherical center valving portion of a circular slightly spherical relatively thin saucer-like bimetallic valve 234 having a plurality of through holes disposed radially outwardly of the spherical valving portion. A pair of recesses 236 in the base plate of non-orbiting scroll member 66, one on each side of cavity 226, help to improve the thermal response time for valve assembly 204.

Valve 234 is retained in place by a cup-shaped spider-like retaining ring 240 which has an open center portion and a plurality of spaced radially outwardly extending fingers 242 which are normally of slightly larger diameter than the side wall of cavity 226. After valve 234 is assembled in place, retaining ring 240 is pushed into cavity 226 until it bottoms out on a plurality of flanges which extend from fingers 242. Retaining ring 240 is held in place by fingers 242 engaging the side wall of cavity 226.

Being disposed in annular recess 80, valve 234 is not exposed to gas at discharge pressure but is instead exposed to gas at a pressure intermediate the suction pressure and the discharge pressure of the compressor. Pressure differential across valve 234 is not an issue since the intermediate chamber pressure is by design less than the discharge pressure. The size of passages 230 and 232 must be large when compared to the size of passageway 84 which supplies the pressurized fluid to recess 80. However, this does not create a problem and is consistent with the benefits of having a small diameter passageway 84. One limitation of placing valve 234 in recess 80 is that the sensing of the temperature of the discharge gas is not a direct sensing. The materials of bimetallic valve 234 are chosen, using conventional criteria, so that when intermediate pressure gas reaches a predetermined value, which is considered excessive, valve 234 will "snap" into its open position in which it is slightly concave upwardly with its outer periphery engaging step 228 and its center valving portion elevated away from the valve seat. In this position, the intermediate pressure gas can leak through the holes in valve 234 and passages 230 and 232 to the interior of shell 10 at suction pressure. This leakage causes floating seal 82 to drop which allows direct communication between discharge and suction by breaking top seal 130. In order to ensure reliable opening of floating seal 82, a wave spring 246 is added between floating seal 82 and partition 16.

In addition to wave spring 246, a second feature is included to ensure the reliable opening of seal 82. In operation, when floating seal 82 first opens and the open area at top seal 130 is relatively small, the discharge gas leaking across seal 130 flows at a high velocity. This high velocity flow of the discharge gas is sufficient to cause the gas pressure in the area to be slightly below the suction pressure. The resulting pressure differential across floating seal 82 tends to counteract wave spring 246 and close seal 130. The operating envelope of the compressor limits the magnitude of force that wave spring 246 can be designed to supply and thus the need for the second feature.

Figure 3:
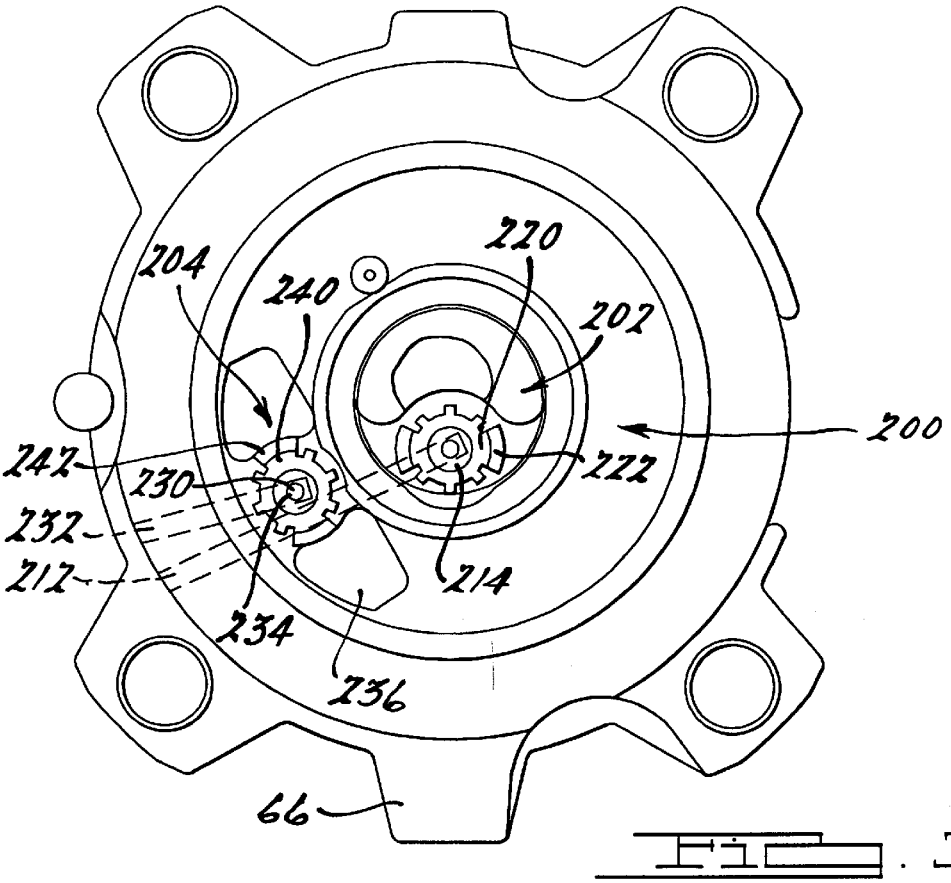
FIG. 3 is a top plan view partially in cross section of the scroll machine shown in FIGS. 1 and 2.

Floating seal 82 has been modified to include an annular upward projection 248 located radially outward from seal 130. While projection 248 is illustrated as a separate component, it is within the scope of the present invention to have projection 248 unitary or integral with seal plate 110. Annular upward projection 248 is included to create an obstacle that the discharge gas leaking across seal 30 must go around. This circuitous route causes a pressure drop before reaching the suction chamber of the compressor but does not cause a significant pressure drop across seal 130. Thus, projection 248 keeps the pressure above floating seal 82 greater than suction pressure and allowing wave spring 246 to completely open floating seal 82. The temperature setting for valve assembly 204 is set to be lower than the temperature setting for valve assembly 202. When valve assembly 202 snaps open due to excess discharge gas temperature, the high temperature discharge gas flows through passage 212. As shown in FIG. 3, passage 212 is designed to be adjacent to valve assembly 204. Thus, the high temperature discharge gas flowing through passage 210 will increase the temperature of valve assembly 204 causing valve assembly 204 to also snap open unloading floating seal 82 assisted by wave spring 246. The flow of high temperature discharge gas into the suction area of the compressor past floating seal 82 will increase the amount of recirculated gas available to heat the motor and eventually trip motor protector 46 as described above. Second, it essentially equalizes the suction and discharge pressures yielding a reduction in the amount of heat generated in the center portion of scroll members 50 and 66.

Figure 4:
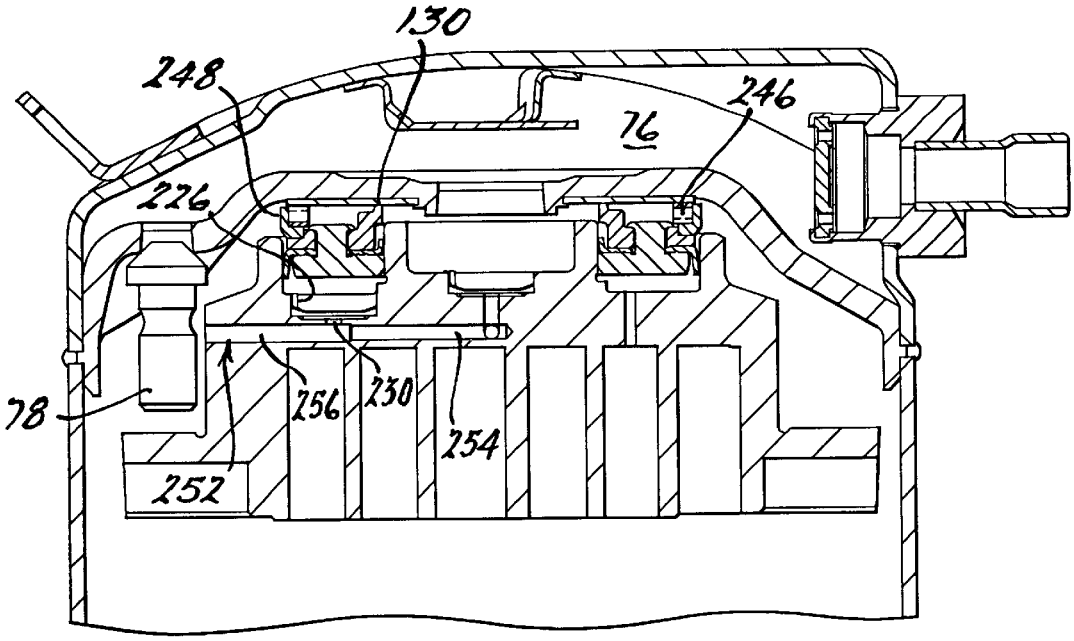
FIG. 4 is an enlarged cross-sectional view of the upper portion of a scroll machine which includes a temperature control system in accordance with another embodiment of the present invention.
Figure 5:
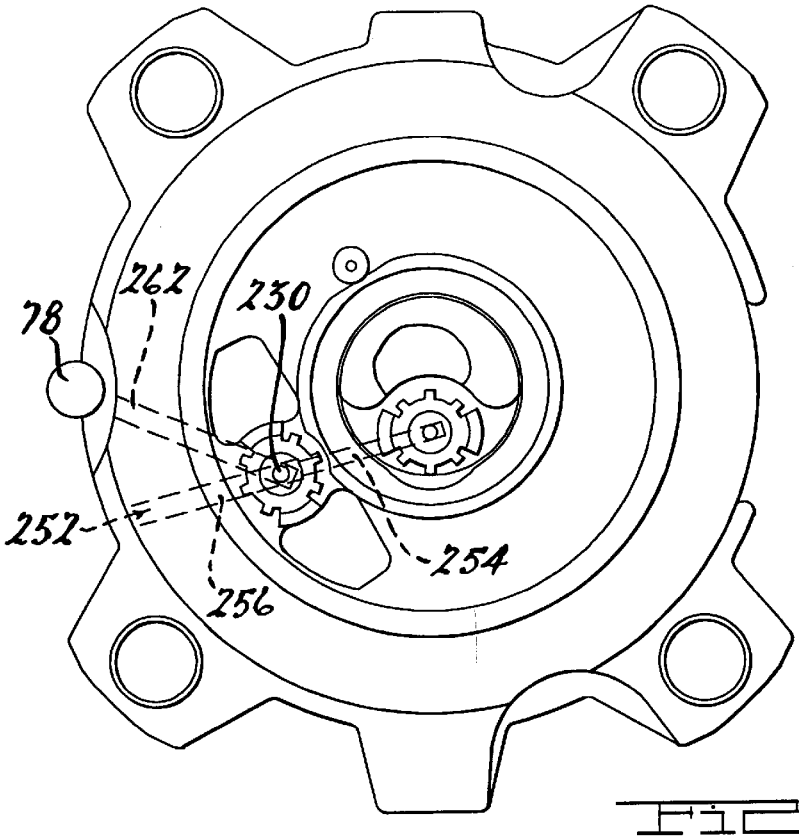
FIG. 5 is a top plan view partially in cross section of the scroll machine shown in FIG. 4.

Referring now to FIGS. 4 and 5, another embodiment of the present invention is disclosed. The embodiment shown in FIGS. 4 and 5 is the same as the embodiment shown in FIGS. 1–3 with the exception of radial passages 212 and 232 which are replaced by passages 252 and 262. The compressor shown in FIG. 1 includes a pressure relief valve 78. When the pressure within discharge muffler chamber 76 exceeds a predetermined pressure, such as might occur in a blocked fan situation, pressure relief valve 78 opens at a specified differential pressure between the discharge and suction pressures to vent gas at discharge pressure to the suction area of the compressor. Passage 252 is positioned to extend immediately below cavity 226 and it includes a reduced diameter section 254 and an enlarged diameter section 256 which begins as passage 252 passes under cavity 226. Passage 262 extends from the outlet of pressure relief valve 78 to intersect with passage 252 at a point directly below axial passage 230. The operation of this embodiment is the same as that described above for FIGS. 1–3 except that passage 262 permits high temperature discharge gas release from pressure relief valve 250 to heat valve 234 causing it to snap open. Thus, temperature protection is provided for conditions of excessive pressure within chamber 76 such as temperature protection in a blocked fan situation.

Figure 6:
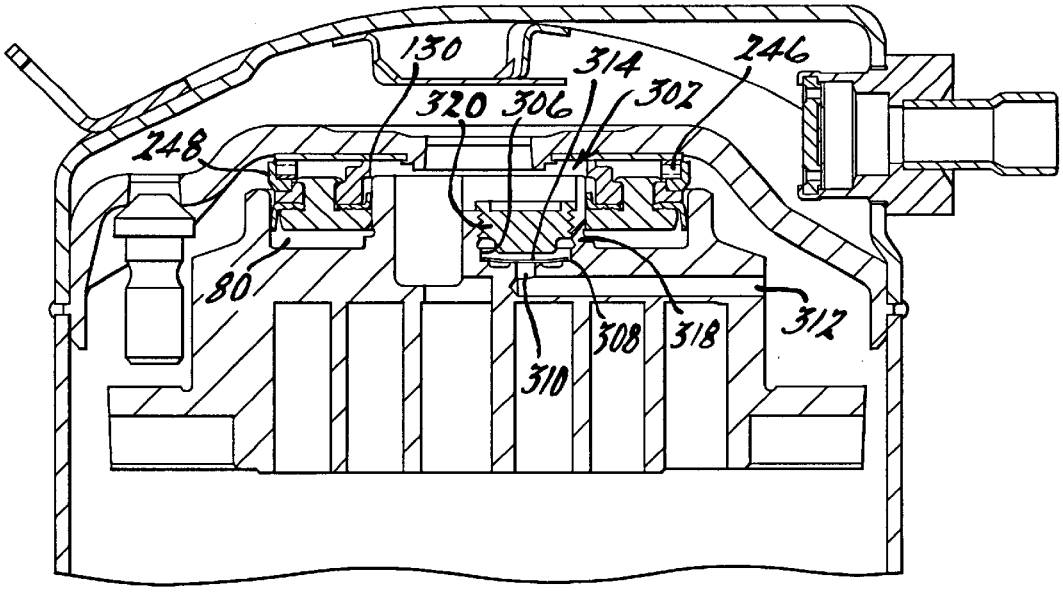
FIG. 6 is an enlarged cross-sectional view of the upper portion of a scroll machine which includes a temperature control system in accordance with another embodiment of the present invention.
Figure 7:
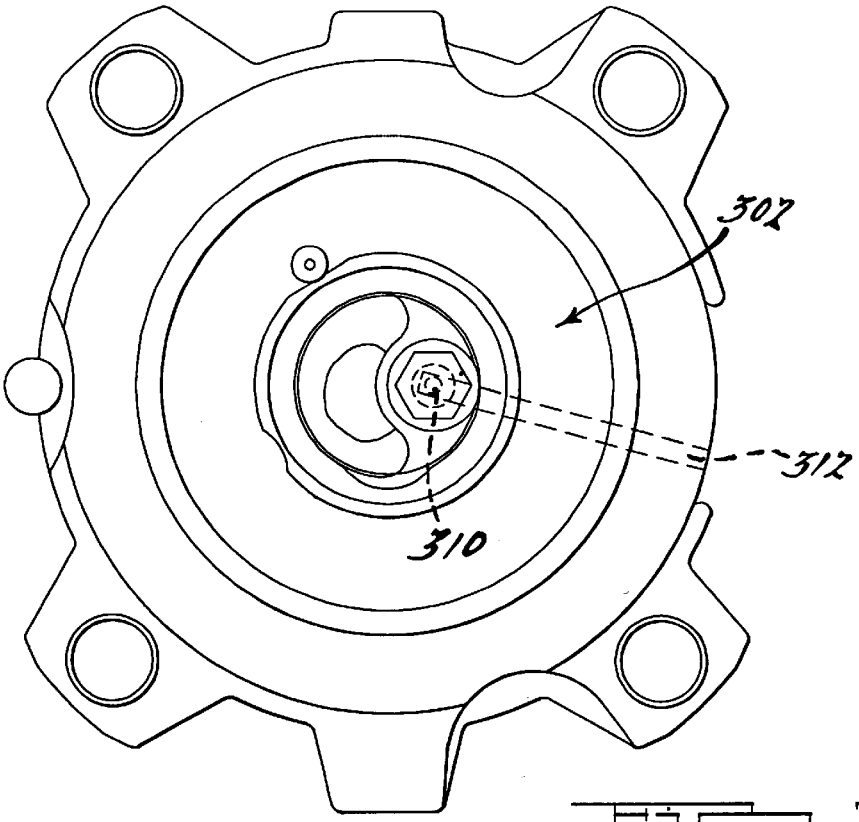
FIG. 7 is a top plan view partially in cross section of the scroll machine shown in FIG. 6.

Referring now to FIGS. 6 and 7, another embodiment of the present invention is disclosed. The embodiment shown in FIGS. 6 and 7 is similar to the embodiment shown in FIGS. 1–3 with the exception that valve assemblies 202 and 204 have been eliminated and replaced by a single temperature responsive valve assembly 302. Temperature responsive valve assembly 302 comprises a circular cavity 306 disposed within recess 72 and having an annular step 308. The bottom of cavity 306 communicates with an axial passage 310 of circular cross section which in turn communicates with a radial passage 312. The radially outer outlet end of passage 312 is in communication with the suction gas region within shell 10. The intersection of passage 310 and the bottom of cavity 306 defines a circular valve seat in which is disposed the spherical center valving portion of a circular slightly spherical relatively thin saucer-like bimetallic valve 314 having a plurality of holes disposed radially outwardly of the spherical valving portion. A second radially extending passage 318 connects cavity 306 with intermediate pressure chamber or recess 80.

Valve 314 is retained in place by a plug 320 which is threadingly received within cavity 306 or otherwise retained within cavity 306. Being disposed within discharge gas recess 72, valve assembly 302 is exposed to the temperature of discharge gas very close to the point it exits scroll wraps 54 and 64. While valve 314 is not in direct contact with discharge gas as is valve 214, this can be accommodated for by reducing the opening temperature of valve 314 as compared to valve 214. This lower temperature setting is possible since valve 314 is exposed to gas at intermediate pressure and not gas at discharge pressure.

Because of plug 320 and passage 318, valve 314 is exposed to gas at a pressure intermediate the suction pressure and the discharge pressure the same as valve 234 described above. Pressure differential across valve 314 is not an issue since the intermediate chamber pressure is by design less than the discharge pressure. The size of passages 310 and 312 must be large when compared to the size of passageway 84 which supplies the pressurized fluid to recess 80. However, this does not create a problem and is consistent with the benefits of having a small passageway 84.

The materials of bimetallic valve 314 are chosen, using conventional criteria, so that when a specific temperature is sensed, which is considered excessive, valve 314 will snap into its open position similar to valve 234 to cause gas at intermediate pressure to leak through passage 318, through the holes in valve 314 and passages 310 and 312 to the interior of shell 10 at suction pressure. This leakage causes floating seal 82 to drop with the assistance of wave-spring 246 to allow discharge gas to leak to suction by breaking top seal 130 of seal 82. In addition to wave spring 246, a second feature is included to ensure the reliable opening of seal 82. In operation, when floating seal 82 first opens and the open area at top seal 130 is relatively small, the discharge gas leaking across seal 130 flows at a high velocity. This high velocity flow of the discharge gas is sufficient to cause the gas pressure in the area to be slightly below the suction pressure. The resulting pressure differential across floating seal 82 tends to counteract wave spring 246 and close seal 130. The operating envelope of the compressor limits the magnitude of force that wave spring 246 can be designed to supply and thus the need for the second feature.

Floating seal 82 has been modified to include an annular upward projection 248 located radially outward from seal 130. While projection 248 is illustrated as a separate component, it is within the scope of the present invention to have projection 248 unitary or integral with seal plate 110. Annular upward projection 248 is included to create an obstacle that the discharge gas leaking across seal 30 must go around. This circuitous route causes a pressure drop before reaching the suction chamber of the compressor but does not cause a significant pressure drop across seal 130. Thus, projection 248 keeps the pressure above floating seal 82 greater than suction pressure and allowing wave spring 246 to completely open floating seal 82. The flow of high temperature discharge gas into the suction area of the compressor past floating seal 82 will increase the amount of recirculated gas available to heat the motor and eventually trip motor protector 46 as described above. Second, it essentially equalizes the suction and discharge pressures yielding a reduction in the amount of heat generated in the center portion of scroll members 50 and 66.

Figure 8:
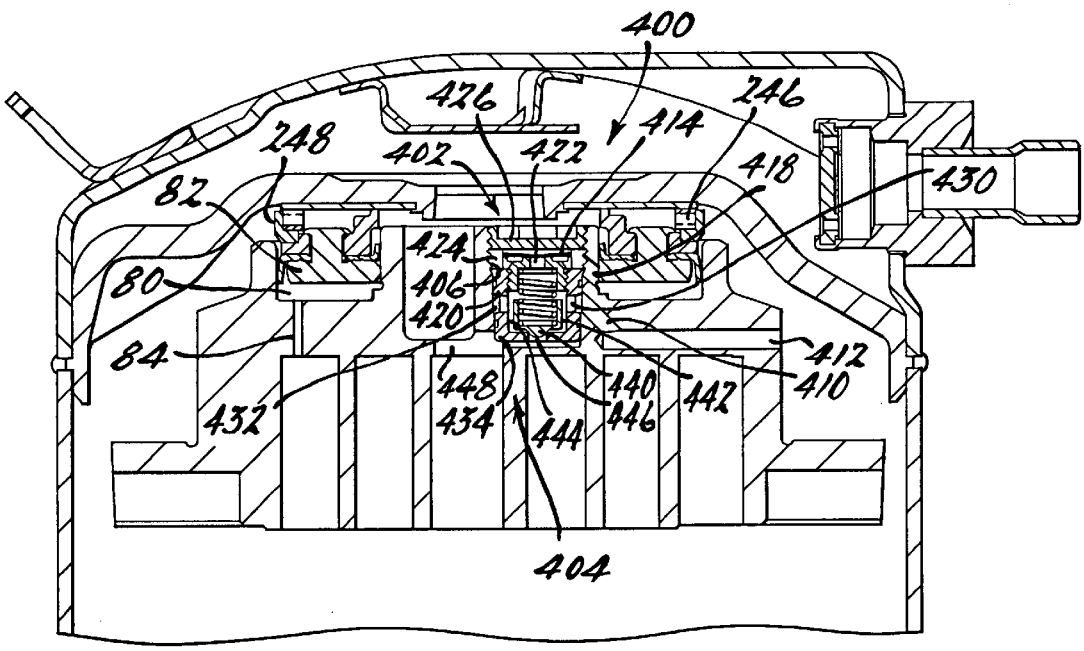
FIG. 8 is an enlarged cross-sectional view of the upper portion of a scroll machine which includes a temperature control system in accordance with another embodiment of the present invention.
Figure 9:
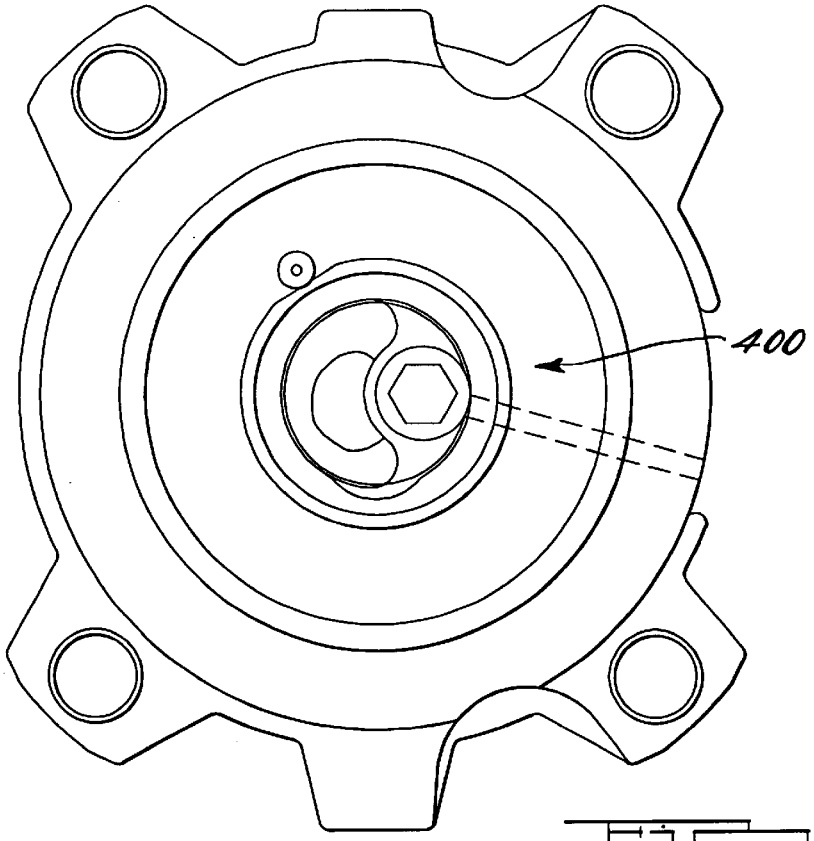
FIG. 9 is a top plan view partially in cross section of the scroll machine shown in FIG. 8.

Referring now to FIGS. 8 and 9, another embodiment of the present invention is disclosed. The embodiment shown in FIGS. 8 and 9 is similar to the embodiment shown in FIGS. 1–3 with the exception that valve assembly 202 and 204 and pressure relief valve 78 have been eliminated and replaced by a single valve assembly 400. Valve assembly 400 comprises a temperature responsive valve assembly 402 and a pressure responsive valve assembly 404.

Temperature responsive valve assembly 402 is disposed within a circular cavity 406 which is located within recess 72. The sidewalls of cavity 406 communicate with a first angular passage 410 of circular cross section which in turn communicates with a radial passage 412. The radial outer outlet end of passage 412 is in communication with the suction gas region within shell 10. A second angularly extending passage 418 extends from cavity 406 to recess 80. Temperature responsive valve assembly 402 comprises a circular slightly spherical relatively thin saucer-like bimetallic valve 414 having a plurality of holes disposed radially outwardly of the spherical valving portion, a valve seat 420 defining a central aperture 422, a star shaped valve guide 424 and a plug 426. The spherical center valving portion of valve 414 seats against valve seat 420 to close central aperture 422 and thus close valve assembly 402.

Valve assembly 402 is retained in place by plug 426 which is threadingly received within cavity 406 or otherwise retained within cavity 406. A pair of 0-rings located between valve guide 424 and cavity 406 provide for the sealing for valve assembly 400. Being disposed within discharge gas recess 72, valve assembly 402 is exposed to the temperature of discharge gas very dose to the point it exits scroll wraps 54 and 64. While valve 414 is not in direct contact with discharge gas as is valve 214, this can be accommodated for by reducing the opening temperature of valve 414 as compared to valve 214 similar to that described above for valve 314. This lower temperature setting is possible since valve 414 is exposed to gas at intermediate pressure and not gas at discharge pressure.

Because of plug 426 and passage 418, valve 414 is exposed to gas at a pressure intermediate the suction pressure and the discharge pressure the same as valves 314 and 234 described above. Pressure differential across valve 414 is not an issue since the intermediate chamber pressure is by design less than the discharge pressure. The size of passages 410 and 412 must be large when compared to the size of passageway 84 which supplies the pressurized fluid to recess 80. However, this does not create a problem and is consistent with the benefits of having a small passageway 84.

The materials of bimetallic valve 414 are chosen, using conventional criteria, so that when a specific temperature is sensed, which is considered excessive, valve 414 will snap into its open position similar to valves 314 and 234 to cause gas at intermediate pressure to leak through passage 418, through star shaped valve guide 424, through the holes in valve 414 and around valve 414, through aperture 422, through a plurality of apertures 430 and a groove 432 formed into a lower portion of valve guide 424 of valve assembly 402, through passages 410 and 412 to the interior of shell 10 at suction pressure. This leakage causes floating seal 82 to drop with the assistance of wave spring 246 to allow discharge gas to leak to suction by breaking top seal 130 of seal 82. In addition to wave spring 246, a second feature is included to ensure the reliable opening of seal 82. In operation, when floating seal 82 first opens and the open area at top seal 130 is relatively small, the discharge gas leaking across seal 130 flows at a high velocity. This high velocity flow of the discharge gas is sufficient to cause the gas pressure in the area to be slightly below the suction pressure. The resulting pressure differential across floating seal 82 tends to counteract wave spring 246 and close seal 130. The operating envelope of the compressor limits the magnitude of force that wave spring 246 can be designed to supply and thus the need for the second feature.

Floating seal 82 has been modified to include an annular upward projection 248 located radially outward from seal 130. While projection 248 is illustrated as a separate component, it is within the scope of the present invention to have projection 248 unitary or integral with seal plate 110. Annular upward projection 248 is included to create an obstacle that the discharge gas leaking across seal 30 must go around. This circuitous route causes a pressure drop before reaching the suction chamber of the compressor but does not cause a significant pressure drop across seal 130. Thus, projection 248 keeps the pressure above floating seal 82 greater than suction pressure and allowing wave spring 246 to completely open floating seal 82. The flow of high temperature discharge gas into the suction area of the compressor past floating seal 82 will increase the amount of recirculated gas available to heat the motor and eventually trip motor protector 46 as described above. Second, it essentially equalizes the suction and discharge pressures yielding a reduction in the amount of heat generated in the center portion of scroll members 50 and 66.

Pressure responsive valve 404 comprises the lower portion of valve guide 424 with apertures 430 and groove 432, a valve 440 and a valve spring 442. Valve body 434 is located within the lower portion of cavity 406 and it defines a cavity 444 and a central aperture 446. Valve 440 is located within cavity 444 and is biased against aperture 446 to close aperture 446 by valve spring 442 which reacts against valve seat 420 of valve assembly 402. Valve seat 420 is threadingly received within cavity 444 or secured within cavity 444 by other means known in the art. The portion of cavity 406 below valve guide 424 is placed into communication with gas at discharge pressure within recess 72 by a passageway 448. During normal operation of the compressor, valve 440 is biased against valve guide 424 by valve spring 442 closing apertures 446. When the discharge pressure exceeds a predetermined value, the gas pressure reacts against valve 440 overcoming the biasing of valve spring 442 to release gas at discharge pressure into cavity 444 where it leaks to the suction area of the compressor through apertures 430, groove 432 and passages 410 and 412. This flow of relatively hot discharge gas heats valve 414 causing it to snap open. Thus, temperature protection is provided for conditions of excessive pressure within recess 72 and chamber 76 such as temperature protection in a blocked fan situation.

Figure 10:
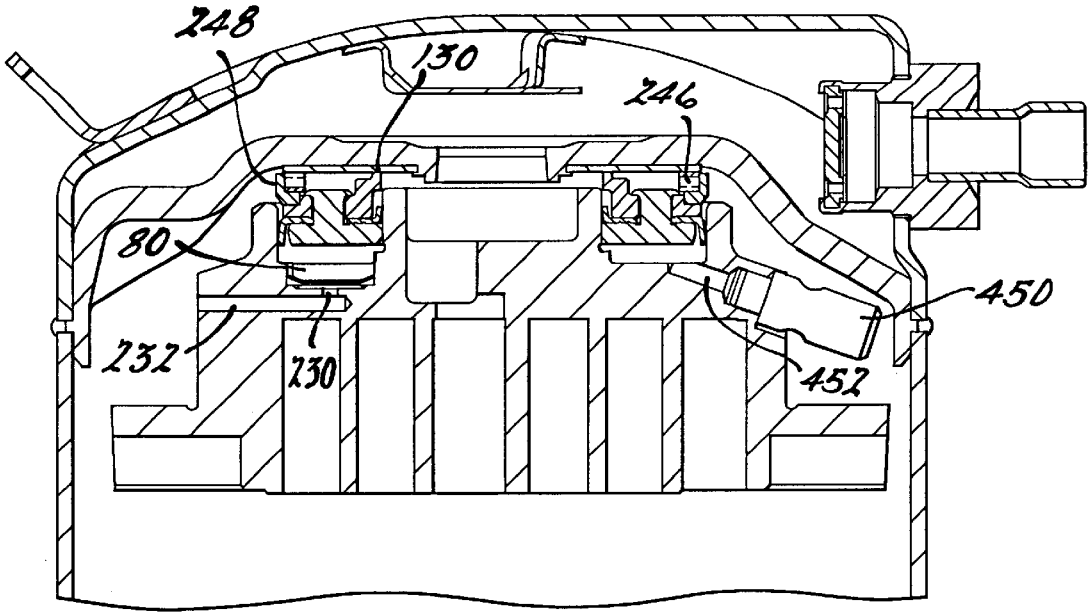
FIG. 10 is an enlarged cross-sectional view of the upper portion of a scroll machine which includes a temperature control system in accordance with another embodiment of the present invention.
Figure 11:
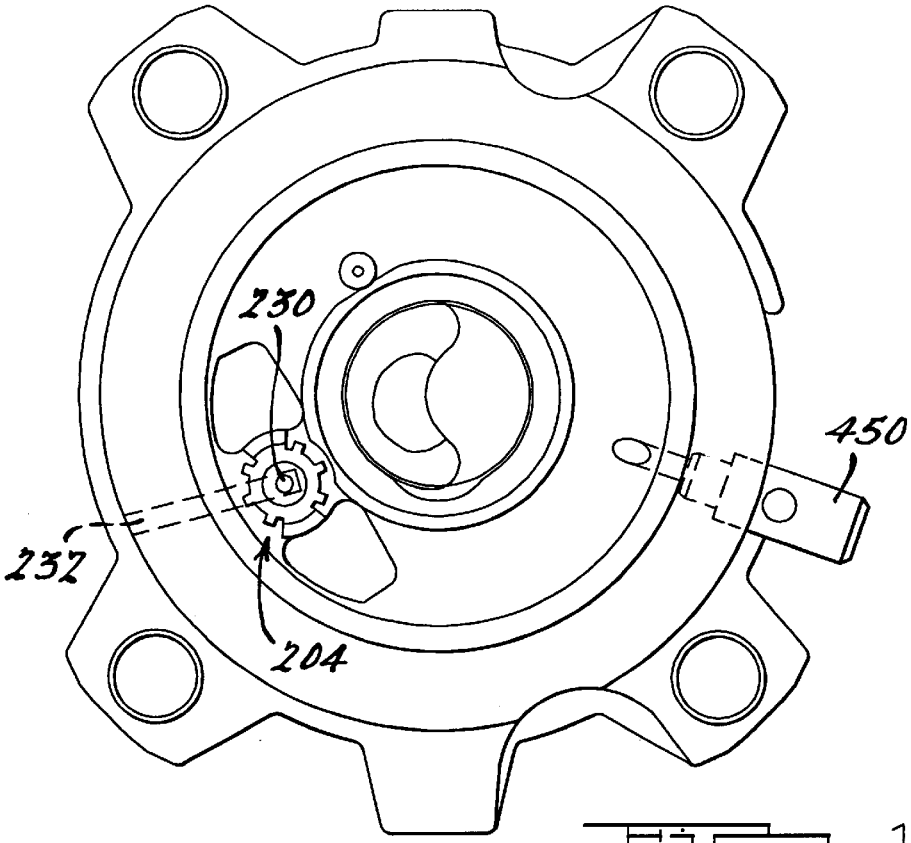
FIG. 11 is a top plan view partially in cross section of the scroll machine shown in FIG. 10.

Referring now to FIGS. 10 and 11, another embodiment of the present invention is disclosed. This embodiment shown in FIGS. 10 and 11 is the same as the embodiment shown in FIGS. 1–3 with the exception that valve assembly 202 and passages 210 and 212 have been eliminated and pressure responsive valve 78 has been replaced by a pressure responsive valve 450. Pressure responsive valve 450 is in communication with recess 80 by an angular passageway 452. The pressure actuating point of pressure responsive valve 450 is designed to respond to the lower intermediate pressure. Upon an over pressurization of recess 80, pressure responsive valve 450 will open leaking intermediate pressurized fluid to suction causing floating seal 82 to drop with the assistance of wave-spring 246 to allow direct communication between discharge and suction by breaking top seal 130. The flow of high temperature discharge gas into the suction area of the compressor will eventually trip motor protector 46 as discussed above.

Typically, intermediate pressure relief (IPR) valve 78 is intended to protect against high discharge pressure (such as caused by a blocked condenser fan) by reacting to a high differential between the discharge and the suction pressure. IPR valve 450 has been moved to the intermediate chamber thus causing it to react to a high differential between intermediate chamber pressure (ICP) and suction pressure. This is an effective form of protection in a flooded start condition. Despite the ICP typically being designed to be independent of the discharge pressure, it has been observed that leakage of discharge pressure into the intermediate chamber will cause IPR valve 450 to open in a blocked fan condition. Rather than relying on leakage to trigger a protection device, the intermediate chamber feed hole is located such that during a small of the crank cycle, the intermediate chamber is exposed to discharge pressure. The ICP then increases as the discharge pressure increases. This feature is beneficial to trigger both IPR valve 450 and temperature responsive valve 204.

Valve assembly 204 is identical to and operates the same as that described above for FIGS. 1–3.

Figure 12:
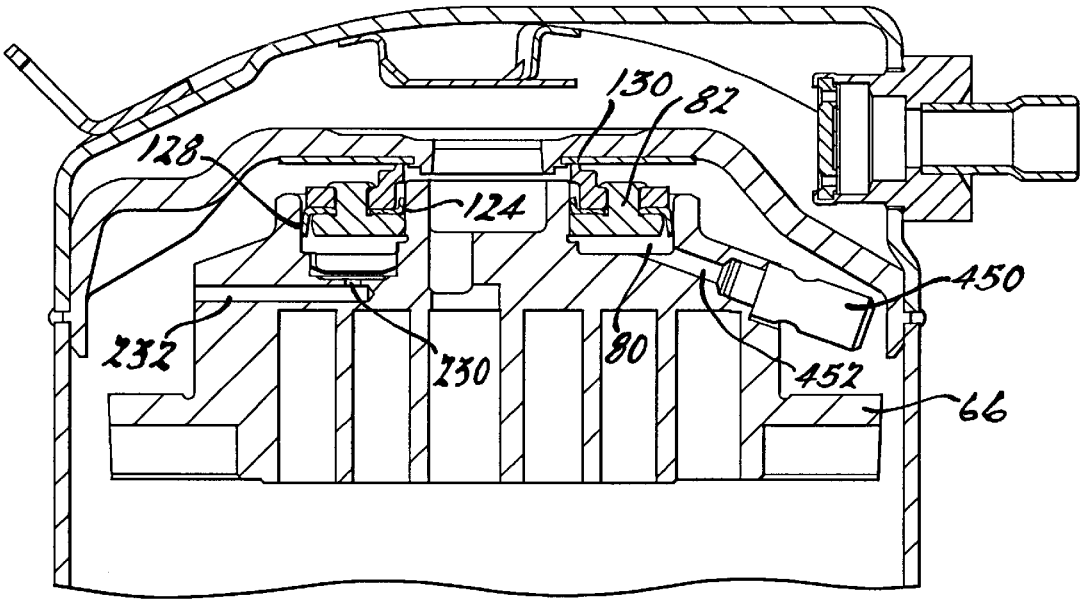
FIG. 12 is an enlarged cross-sectional view of the upper portion of a scroll machine which includes a temperature control system in accordance with another embodiment of the present invention.
Figure 13:
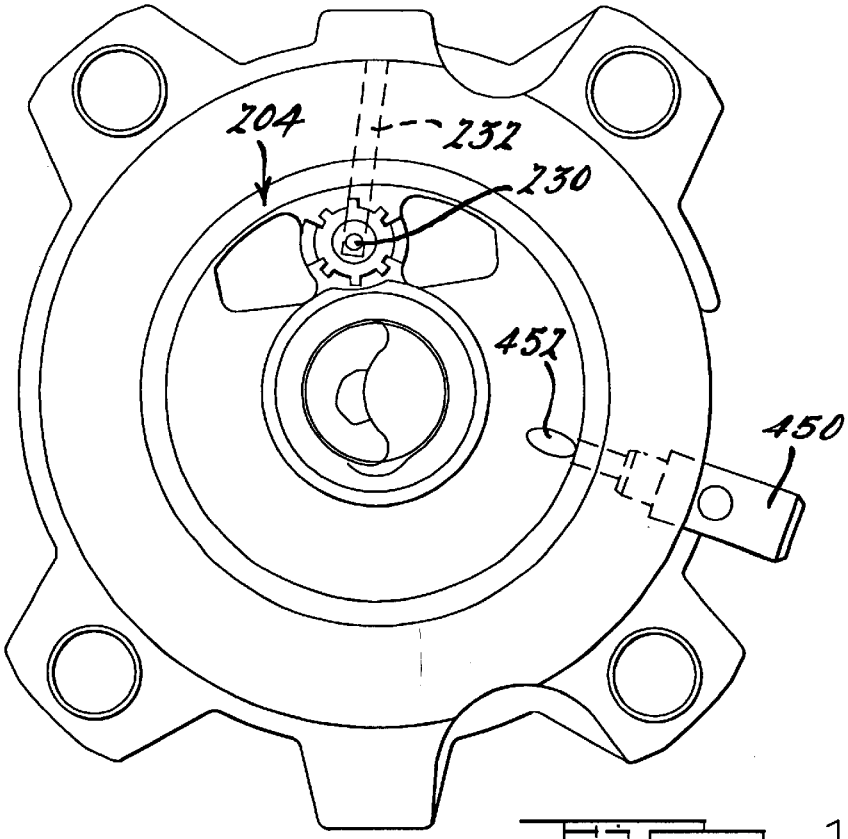
FIG. 13 is a top plan view partially in cross section of the scroll machine shown in FIG. 12.

Referring now to FIGS. 12 and 13, another embodiment of the present invention is illustrated. The embodiment shown in FIGS. 12 and 13 is identical to the embodiment shown in FIGS. 10 and 11 with the exception that the diameters for seals 124 and 130 are reduced in size. The reduction of seal diameters 124 and 130 are chosen such that the axial biasing of non-orbiting scroll member is based only on the intermediate fluid pressure and not on a combination of intermediate fluid pressure and discharge pressure as shown in FIGS. 10 and 11. Seal diameter 124 must be chosen such that the projected area of discharge pressure acting on the upper side of non-orbiting scroll member 66 is less than the average projected area (throughout one revolution of the crankshaft) that the discharge pressure acts on the lower side of the base plate of non-orbiting scroll member 66. The axial biasing effect of the discharge pressure within seal diameter 124 is always more than offset by the separating effect of the discharge pressure in the central region of scroll members 50 and 66. The operation of the embodiment shown in FIGS. 12 and 13 is identical to that described above for FIGS. 10 and 11. The embodiment in FIGS. 12 and 13 provides the advantage that by using the smaller diameter seals, valve assembly 204 is located closer to the discharge passageway of non-orbiting scroll member 66 and recess 74 and thus will be more responsive to the temperature of the discharge gas. In addition, because the axial biasing of non-orbiting scroll member 66 is based only on the intermediate pressure within recess 80, floating seal 82 can be eliminated and replaced by a solid annular member secured to partition 16 and extending from partition 16 into recess 80 if desired.

In this embodiment, the angular position of valve 204 relative to the suction opening in non-orbiting scroll member is selected to provide for maximum thermal response. This location is typically within the range of 180° to 270° clockwise from the suction opening as viewed from above non-orbiting scroll member 66.

Figure 14:
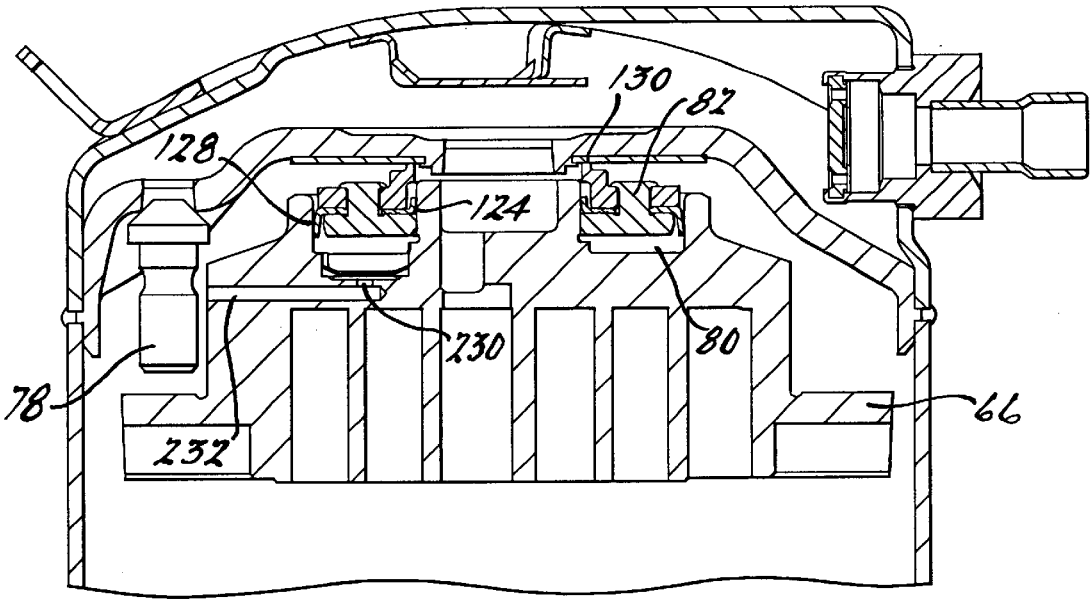
Figure 15:
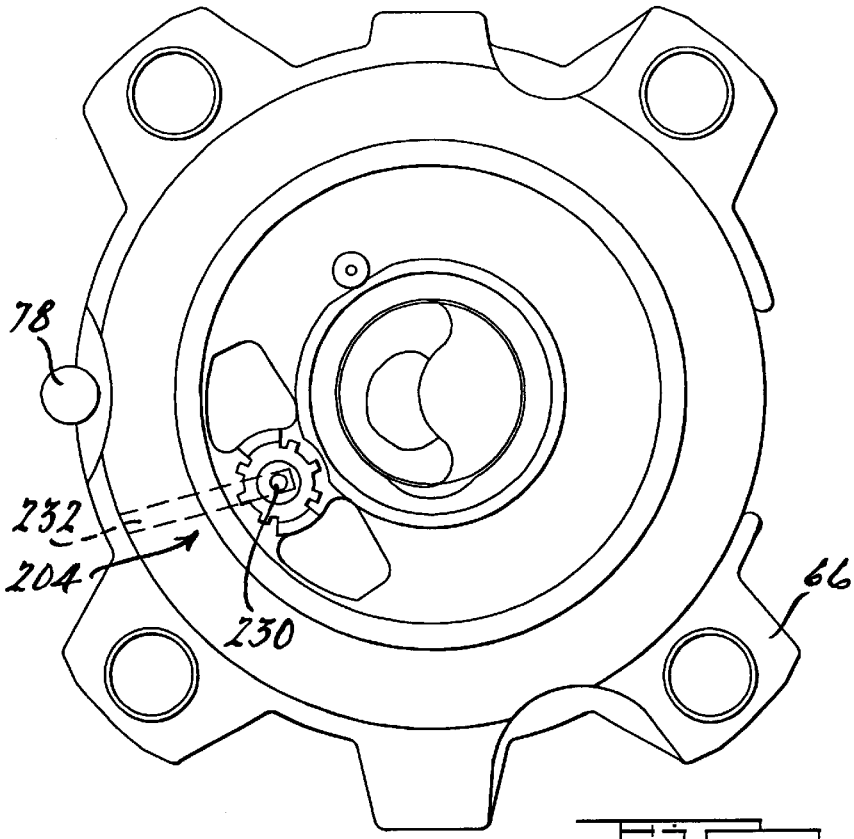
FIG. 15 is a top plan view partially in cross section of the scroll machine shown in FIG. 14.

Referring now to FIGS. 14 and 16, another embodiment of the present invention is illustrated. The embodiment shown in FIGS. 14 and 16 is identical to the embodiment shown in FIGS. 11 and 12 with the exception that valve assembly 204 is shown in conjunction with a typical IPR valve 78 rather than IPR valve 450. The operation of the embodiment shown in FIGS. 14 and 15 is otherwise identical to that described above for FIGS. 11 and 12.

While the above detailed description describes the preferred embodiment of the present invention, it should be understood that the present invention is susceptible to modification, variation and alteration without deviating from the scope and fair meaning of the subjoined claims.

What is claimed is:

1. A scroll machine comprising:

a first scroll member having a first spiral wrap projecting outwardly from a first end plate;

a second scroll member having a second spiral wrap projecting outwardly from a second end plate;

a drive member for causing said scroll members to orbit relative to one another whereby said spiral wraps will create pockets of progressively changing volume between a suction pressure zone and a discharge pressure zone;

a chamber defined by one of said scroll members;

means for supplying said chamber with an intermediate pressurized fluid, said intermediate pressurized fluid being at a fluid pressure between pressurized fluid in said suction pressure zone and pressurized fluid in said discharge pressure zone;

a first temperature responsive valve assembly disposed within a passage extending between said chamber and said suction pressure zone, said first temperature responsive valve assembly releasing said intermediate pressurized fluid from said chamber to said suction pressure zone upon sensing a temperature in excess of a first predetermined value.

2. The scroll machine according to claim 1, further comprising a second temperature responsive valve assembly disposed in a passage extending between said discharge pressure zone and said suction pressure zone, said second temperature responsive valve assembly releasing said pressurized fluid in said discharge pressure zone to said suction pressure zone upon sensing a temperature in excess of a second predetermined value.

3. The scroll machine according to claim 2, wherein said passage extending between said discharge pressure zone and said suction pressure zone is located adjacent said first temperature responsive valve assembly.

4. The scroll machine according to claim 1, further comprising a pressure responsive valve assembly disposed between said discharge pressure zone and said suction pressure zone, said pressure responsive valve assembly releasing said pressurized fluid in said discharge pressure zone to said suction pressure zone upon sensing a pressure in excess of a predetermined pressure.

5. The scroll machine according to claim 4, wherein said pressurized fluid released by said pressure responsive valve assembly is directed towards said first temperature responsive valve assembly.

6. The scroll machine according to claim 4, wherein said pressurized fluid released by said pressure responsive valve assembly is directed into said passage extending between said chamber and said suction pressure zone.

7. The scroll machine according to claim 4, further comprising a second temperature responsive valve assembly disposed in a passage extending between said discharge pressure zone and said suction pressure zone, said second temperature responsive valve assembly releasing said pressurized fluid in said discharge pressure zone to said suction pressure zone upon sensing a temperature in excess of a second predetermined value.

8. The scroll machine according to claim 7, wherein said passage extending between said discharge pressure zone and said suction pressure zone intersects with said passage extending between said chamber and said suction pressure zone.

9. The scroll machine according to claim 4, wherein said first temperature responsive valve is disposed within a cavity defined by said one scroll member, said pressure responsive valve also being disposed within said cavity.

10. The scroll machine according to claim 9, wherein said pressurized fluid released by said pressure responsive valve assembly is directed towards said first temperature responsive valve assembly.

11. The scroll machine according to claim 1, wherein said first temperature responsive valve assembly is disposed within said discharge pressure zone.

12. The scroll machine according to claim 11, wherein said first temperature responsive valve assembly includes a thermal responsive disk, said thermal responsive disk being located from said fluid in said discharge pressure zone.

13. The scroll machine according to claim 1, further comprising a pressure responsive valve assembly disposed between said chamber and said suction pressure zone, said pressure responsive valve assembly releasing said intermediate pressurized fluid in said chamber to said suction pressure zone upon sensing a pressure in excess of a predetermined pressure.

14. The scroll machine according to claim 1, further comprising a leakage path disposed between two components of said scroll machine, said leakage path extending between said discharge pressure zone and said suction pressure zone, said leakage path being closed due to the influence of said intermediate pressurized fluid biasing said two components together, said leakage path being opened when said intermediate pressurized fluid is released by said first temperature responsive valve.

15. The scroll machine according to claim 1, wherein said one scroll machine is mounted for limited axial movement with respect to the other scroll member, said one scroll member being biased toward said other scroll member by said intermediate pressurized fluid.

16. The scroll machine according to claim 15, further comprising a second temperature responsive valve assembly disposed in a passage extending between said discharge pressure zone and said suction pressure zone, said second temperature responsive valve assembly releasing said pressurized fluid in said discharge pressure zone to said suction pressure zone upon sensing a temperature in excess of a second predetermined value.

17. The scroll machine according to claim 16, wherein said passage extending between said discharge pressure zone and said suction pressure zone is located adjacent said first temperature responsive valve assembly.

18. The scroll machine according to claim 15, further comprising a pressure responsive valve assembly disposed between said discharge pressure zone and said suction pressure zone, said pressure responsive valve assembly releasing said pressurized fluid in said discharge pressure zone to said suction pressure zone upon sensing a pressure in excess of a predetermined pressure.

19. The scroll machine according to claim 18, wherein said pressurized fluid released by said pressure responsive valve assembly is directed towards said first temperature responsive valve assembly.

20. The scroll machine according to claim 18, wherein said pressurized fluid released by said pressure responsive valve assembly is directed into said passage extending between said chamber and said suction pressure zone.

21. The scroll machine according to claim 18, further comprising a second temperature responsive valve assembly disposed in a passage extending between said discharge pressure zone and said suction pressure zone, said second temperature responsive valve assembly releasing said pressurized fluid in said discharge pressure zone to said suction pressure zone upon sensing a temperature in excess of a second predetermined value.

22. The scroll machine according to claim 21, wherein said passage extending between said discharge pressure zone and said suction pressure zone intersects with said passage extending between said chamber and said suction pressure zone.

23. The scroll machine according to claim 18, wherein said first temperature responsive valve is disposed within a cavity defined by said one scroll member, said pressure responsive valve also being disposed within said cavity.

24. The scroll machine according to claim 23, wherein said pressurized fluid released by said pressure responsive valve assembly is directed towards said first temperature responsive valve assembly.

25. The scroll machine according to claim 15, wherein said first temperature responsive valve assembly is disposed within said discharge pressure zone.

26. The scroll machine according to claim 25, wherein said first temperature responsive valve assembly includes a thermal responsive disk, said thermal responsive disk being located from said fluid in said discharge pressure zone.

27. The scroll machine according to claim 15, further comprising a pressure responsive valve assembly disposed between said chamber and said suction pressure zone, said pressure responsive valve assembly releasing said intermediate pressurized fluid in said chamber to said suction pressure zone upon sensing a pressure in excess of a predetermined pressure.

28. The scroll machine according to claim 15, further comprising a leakage path disposed between two components of said scroll machine, said leakage path extending between said discharge pressure zone and said suction pressure zone, said leakage path being closed due to the influence of said intermediate pressurized fluid biasing said two components together, said leakage path being opened when said intermediate pressurized fluid is released by said first temperature responsive valve.

* * * * *

UNITED STATES PATENT AND TRADEMARK OFFICE

CERTIFICATE OF CORRECTION

PATENT NO. : 6,267,565 B1
DATED : July 31, 2001
INVENTOR(S) : Stephen M. Seibel and James F. Fogt It is certified that error appears in the above-identified patent and that said Letters Patent is hereby corrected as shown below:

Column 2,
Line 39, "12" should be -- 14 --.

Column 9,
Line 64, "dose" should be -- close --.

Column 11,
Line 50, after "small" insert -- portion --.

Signed and Sealed this

Fourteenth Day of May, 2002

*Attest:*

*Attesting Officer*

JAMES E. ROGAN
*Director of the United States Patent and Trademark Office*